US008973536B2

(12) United States Patent
Hagman et al.

(10) Patent No.: US 8,973,536 B2
(45) Date of Patent: Mar. 10, 2015

(54) ENGINE COMPENSATION FOR FAN POWER

(71) Applicant: Caterpillar, Inc., Peoria, IL (US)

(72) Inventors: Brandon L. Hagman, Decatur, IL (US); Matthew D. Meads, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/749,939

(22) Filed: Jan. 25, 2013

(65) Prior Publication Data

US 2014/0209047 A1 Jul. 31, 2014

(51) Int. Cl.

*F01P 7/10* (2006.01)
*F01P 7/02* (2006.01)
*F01P 7/04* (2006.01)

(52) U.S. Cl.

CPC .. *F01P 7/02* (2013.01); *F01P 7/044* (2013.01)
USPC ..... 123/41.49; 123/41.11; 123/41.56

(58) Field of Classification Search

CPC ..... F01P 7/044; F01P 11/10; F01P 2025/60; F01P 2025/66; F02B 29/0456
USPC ..... 123/41.01, 41.11, 41.12, 41.49, 41.56, 123/41.65, 41.63
See application file for complete search history.

(56) References Cited

U.S. PATENT DOCUMENTS 5,706,782 A * 1/1998 Kurihara ..... 123/399
6,094,617 A 7/2000 Lapke
6,772,060 B2 8/2004 McCauley et al.
6,842,689 B2 1/2005 Andres et al.
6,920,387 B2 7/2005 Landes et al.
7,206,689 B1 4/2007 Johnson
7,281,370 B2 * 10/2007 Furuta et al. ..... 60/329
7,373,239 B2 5/2008 Kamado et al.
7,797,092 B2 9/2010 Schifferer et al.
8,009,028 B2 * 8/2011 Uesaka et al. ..... 340/450.2
8,062,169 B2 * 11/2011 Marr et al. ..... 477/3
2002/0157397 A1 * 10/2002 Kapich ..... 60/608
2007/0209610 A1 * 9/2007 Bradley et al. ..... 123/41.29
2007/0284480 A1 * 12/2007 Atkey et al. ..... 244/135 R
2008/0269009 A1 * 10/2008 Marr et al. ..... 477/3
2009/0007856 A1 1/2009 Minekawa
2011/0011356 A1 1/2011 Tanaka et al.
2012/0241235 A1 * 9/2012 Shintani et al. ..... 180/68.1
2013/0005531 A1 * 1/2013 Sung et al. ..... 477/84
2013/0092366 A1 * 4/2013 Hyodo et al. ..... 165/287

* cited by examiner

*Primary Examiner* — Noah Kamen
*Assistant Examiner* — Long T Tran
(74) *Attorney, Agent, or Firm* — BakerHostetler

(57) ABSTRACT

A method for controlling the power of an engine is provided. The method includes determining a baseline fuel amount, determining an engine cooling fan operating condition based on an engine operating parameter, determining an engine cooling fan command based on the engine cooling fan operating condition, determining an engine cooling fan power level based on the engine speed and the engine cooling fan command, determining an additional fuel amount based on the engine cooling fan power level, adding the additional fuel amount to the baseline fuel amount to create a compensated fuel amount, and providing the compensated fuel amount to the engine. An engine system, including an engine controller coupled to an engine, a fuel system and a hydraulic pump, is also provided. The engine controller includes a processor adapted to perform a set of instructions that controls the power of the engine.

20 Claims, 5 Drawing Sheets

ENGINE COMPENSATION FOR FAN POWER

TECHNICAL FIELD

The present disclosure relates to internal combustion engines. More particularly, the present disclosure relates to internal combustion engines with interconnected cooling systems.

BACKGROUND

Machines, such as motorgraders, wheel loaders, wheel dozers, track type tractors, track loaders, etc., are powered by internal combustion engines, such as, for example, diesel engines, that are connected to an engine cooling system. Generally, engine coolant is pumped from a reservoir to the engine, heated, provided to a radiator, cooled, and returned to the reservoir. The coolant flows through, and is heated within, various passages in the engine block; similarly, the coolant flows through, and is cooled within, various passages in the radiator. While there may be some radiative cooling, air is forced over the radiator to provide convective cooling. Machines use a cooling fan to provide air flow over the radiator to transfer heat from the coolant, such as, for example, a hydraulic fan, an electric fan, a belt-driven fan, etc. For example, a hydraulic cooling fan may be connected to a hydraulic circuit that includes a hydraulic pump powered by the engine. As a parasitic load, the hydraulic cooling fan draws power from the engine, and may consume a certain, noticeable percentage of the engine power output, such as, for example, 5%, 10%, 15%, etc. Reduced engine power output affects the performance of the machines, such as, for example, the drawbar performance of a motorgrader.

For a machine engine that provides power to intermittent loads, such as a manually-operated implement, as well as to parasitic loads, such as an automatically-operated electrical load, hydraulic load, etc., one known engine control method adjusts gross engine power to provide a predetermined net power to a main power recipient (MPR) component of the vehicle, such as, for example, a transmission system, drive train and the like. U.S. Pat. No. 6,842,689 discloses a method that determines a predetermined net power to be provided to the MPR component, determines parasitic and/or intermittent load power during operation, and adjusts gross engine power to provide the predetermined net power to the MPR component during operation. A method that adjusts gross engine power, generally, to compensate for parasitic loads, such as a hydraulic cooling fan, is desirable.

SUMMARY

One aspect of the present disclosure provides a method for controlling the power of an engine. The method includes determining a baseline fuel amount based on a speed of the engine, determining an engine cooling fan operating condition based on at least one engine operating parameter, determining an engine cooling fan command based on the engine cooling fan operating condition, determining an engine cooling fan power level based on an engine speed and the engine cooling fan command, determining an additional fuel amount based on the engine cooling fan power level, adding the additional fuel amount to the baseline fuel amount to create a compensated fuel amount, and providing the compensated fuel amount to the engine.

Another aspect of the present disclosure provides an engine system. The engine system includes an engine, a fuel system coupled to the engine, a cooling system, coupled to the engine, including a radiator and a hydraulic cooling fan coupled to a hydraulic pump, and an engine controller coupled to the engine, the fuel system and the hydraulic pump. The engine controller includes a processor adapted to perform a set of instructions that control the power of the engine which include determining an engine cooling fan operating condition based on at least one engine operating parameter, determining an engine cooling fan command based on the engine cooling fan operating condition, determining an engine cooling fan power level based on an engine speed and the engine cooling fan command, determining an additional fuel amount based on the engine cooling fan power level, adding the additional fuel amount to the baseline fuel amount to create a compensated fuel amount, and providing the compensated fuel amount to the engine.

Another aspect of the present disclosure provides a method for controlling the power of an engine that includes determining a baseline fuel amount for the engine, determining an increased fuel amount greater than the baseline fuel amount to compensate for cooling fan power, and providing the increased fuel amount to the engine. Yet another aspect of the present disclosure provides a method for controlling the power of an engine that includes determining a maximum fuel amount for the engine, determining a reduced fuel amount less than the maximum fuel amount to compensate for the difference between a maximum cooling fan power and an actual cooling fan power, and providing the reduced fuel amount to the engine.

DETAILED DESCRIPTION

Figure 1:
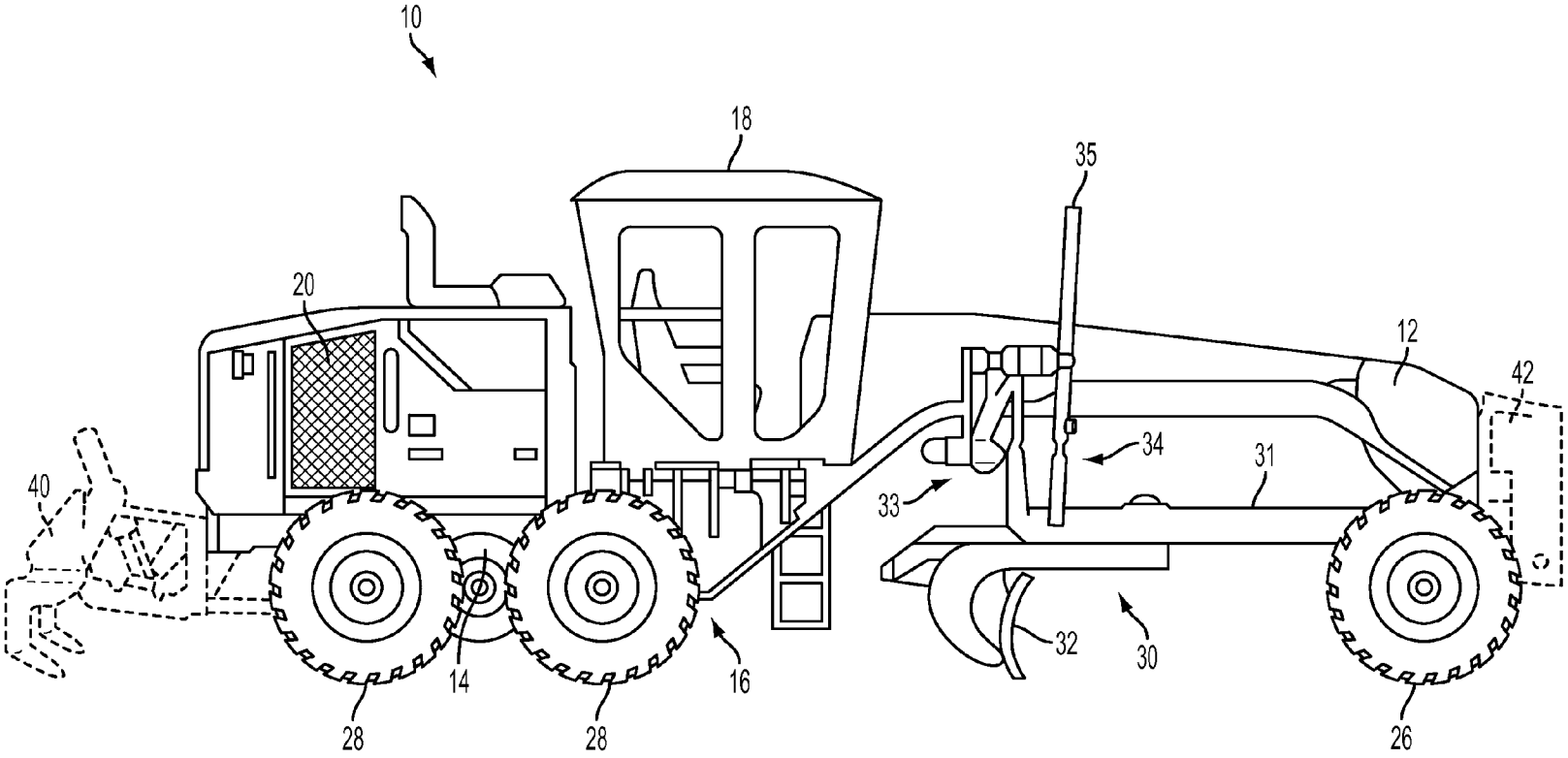
FIG. 1 is a side view of a machine, in accordance with an embodiment of the disclosure.

The disclosure will now be described with reference to the drawing figures, in which like reference numerals refer to like parts throughout.

FIG. 1 presents a side view of a machine 10, in accordance with an embodiment of the present disclosure. While machine 10 is depicted in FIG. 1 as a motorgrader, other types of machines, such as, for example, wheel loaders, wheel dozers, track type tractors, track loaders, etc., are also contemplated by the present disclosure.

Machine 10 includes a front frame 12 and a rear frame 14, coupled together via an articulated hitch 16. Alternatively, machine 10 may include a non-articulated mainframe. Front frame 12 is supported by a pair of articulated front wheels 26, while rear frame 14 is supported by a pair of tandem rear wheels 28. Alternatively, machine 10 may include a single pair of rear wheels, a pair of track assemblies, etc. Front frame 12 supports an operator cab 18, while rear frame 14 supports an engine compartment 20. Cab 18 houses the operator and includes one or more joysticks, control pods, foot pedals, operator displays, electronic control modules, etc., while engine compartment 20 houses an engine system, including an engine, an intake system, an exhaust system and an engine control system, as well as other engine support systems, such as, for example, a fuel system, a cooling system, a lubrication system, etc. A hydraulic system, including one or more hydraulic circuits, may also be housed within engine compartment 20. The engine control system may include one or more microprocessor-based controllers that are coupled to the engine, intake and exhaust systems, as well as other support systems, and configured to control the function of these components. The cooling system may include a reservoir, a pump, a radiator and a hydraulic cooling fan coupled to, and powered by, a hydraulic circuit. Various hoses and lines connect the components of the cooling system to the engine. Other types of fans may be used within the cooling system, such as, for example, electric fans, belt-driven fans, etc.

Blade assembly 30 is coupled to a front portion of front frame 12 via drawbar 31, and to a central portion of front frame 12 via linkage 33. Various hydraulic actuators 34, such as, for example, blade lift cylinders 35, blade side shift cylinder, blade pitch cylinder, circle rotation cylinder, drawbar center shift cylinder, etc., articulate blade assembly 30 and blade 32 with respect to the ground. Optional work tools may include a ripper or scarifier 40 attached to rear frame 14, and a dozer blade or counterweight 42 attached to front frame 12.

Figure 2:
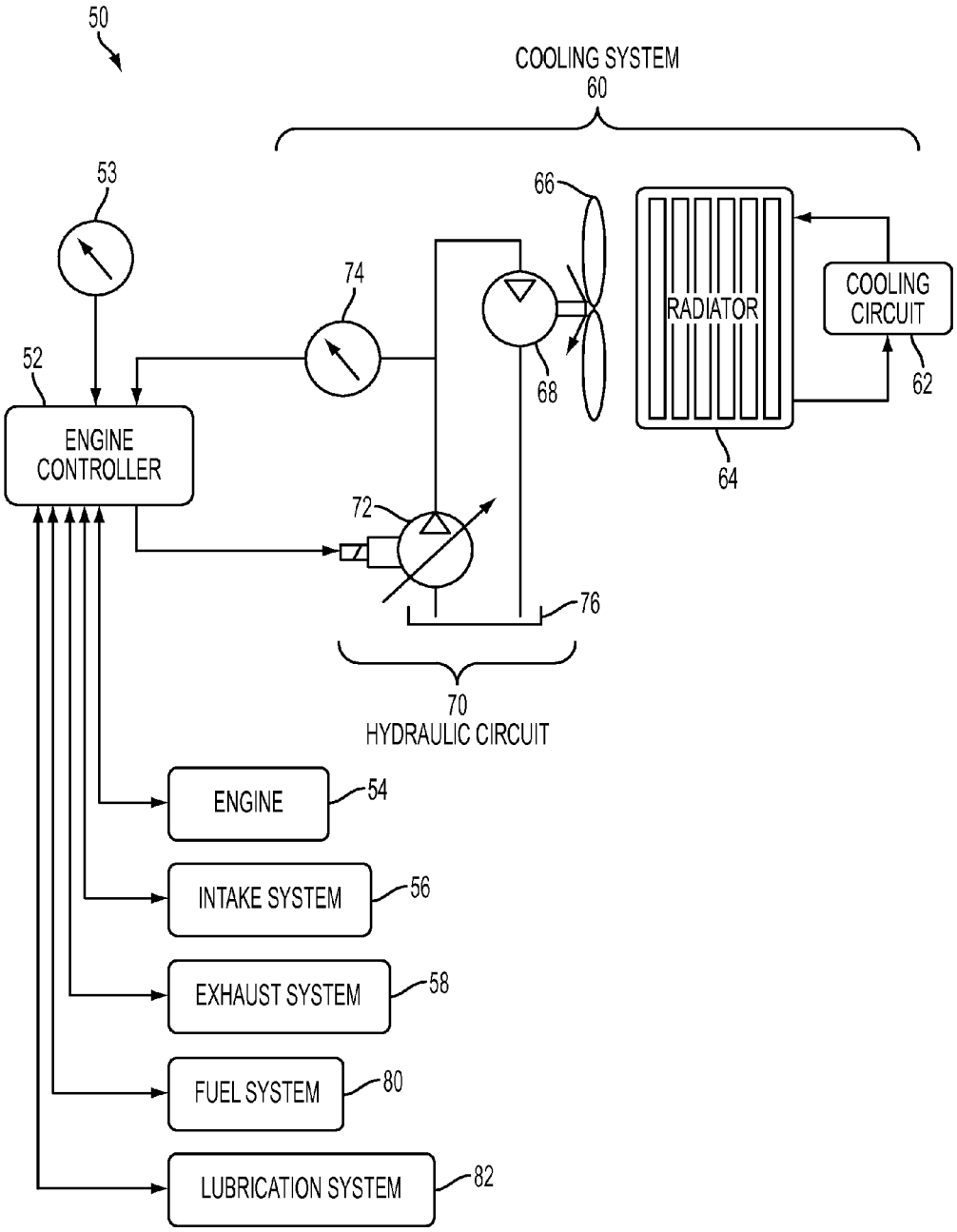
FIG. 2 is a schematic representation of certain components of an engine system, a fuel system and a cooling system for a machine, in accordance with the disclosure.

FIG. 2 presents a schematic representation of certain components of an engine system, a fuel system and a cooling system for a machine, in accordance with the disclosure.

Engine system 50 may include an engine control module, engine control unit or engine controller 52, an engine 54, an intake system 56 and an exhaust system 58. Engine controller 52 may include one or more microprocessors, volatile and non-volatile memory, and input and output ports that are connected to various sensors and actuators. Engine 54 may be an internal combustion engine, such as, for example, a diesel engine, a gasoline engine, a natural gas engine, etc., or any other gaseous fuel engine whose power at any given engine speed may be controlled by regulating the amount of fuel delivered to the engine by the fuel system 80. In one embodiment, engine 54 may be a diesel engine including an engine block with four or more cylinders arranged in an "in-line" or "V" configuration.

One or more engine speed sensors, such as active single or dual Hall Effect sensors, measure the rotational speed of the engine crankshaft, or, alternatively, a drivetrain component, and are coupled to the engine controller 52. In one embodiment, engine controller 52 controls engine power by varying the amount of fuel delivered to the engine cylinders, according to one or more engine performance curves or tables, correlating engine power or torque at different engine speeds to the required fuel quantity, which may be stored in memory. One or more atmospheric pressure sensors 53 may also be coupled to engine controller 52, and may be disposed within the engine block, the enclosure, one or more electronic control modules (ECM), the intake system 56, the engine air intake passages, etc.

Intake system 56 delivers air to the engine 54, while exhaust system 58 directs combustion gases to the atmosphere. Fuel system 80 may include a fuel tank, one or more pumps, filters, etc., and various hoses and pipes to connect the fuel system components to the engine 54. Similarly, lubrication system 82 may include an oil tank, one or more pumps, filters, etc., and various hoses and pipes to connect the lubrication system components to the engine 54.

Cooling system 60 may include a cooling circuit 62, at least one radiator 64 and a hydraulic cooling fan 66 powered by a constant displacement hydraulic motor 68. Cooling system 60 may provide coolant to engine 54, as well as to other support systems within engine system 50. Additionally, other support systems, such as, for example, the lubrication system 82, may include one or more radiators or heat exchangers within their respective fluid circuits, which may be serviced by the hydraulic cooling fan 66. In other words, hydraulic cooling fan 66 may provide cooling air not only to radiator 64, but also to one or more radiators within other support systems.

Hydraulic circuit 70 may include a solenoid-controlled variable displacement hydraulic pump 72 coupled to the hydraulic cooling fan 66 and a pressure sensor 74, and a reservoir 76 coupled to the hydraulic pump 72 and the hydraulic cooling fan 66. The solenoid of hydraulic pump 72 may be connected to the engine controller 52, which controls the displacement of the hydraulic pump 72 by setting an electrical current provided to the solenoid. Alternatively, hydraulic circuit 70 may include a constant displacement hydraulic pump with a pressure bypass to control hydraulic cooling fan 66.

INDUSTRIAL APPLICABILITY

Embodiments of the present disclosure advantageously provide methods that adjust engine power to compensate for hydraulic cooling fan loads. Additional embodiments adjust engine power to compensate for hydraulic cooling fan loads at different altitudes above sea level. While these methods offer engine performance improvements for machines, such as motorgraders, wheel loaders, wheel dozers, track type tractors, track loaders, etc., any engine system that includes a parasitic engine cooling fan load may benefit.

Engine power control may be facilitated through the use of engine power curves that provide the amount of fuel required to be delivered by fuel system 80 to produce a given engine power at various engine speeds.

Engine cooling requirements are determined by engine controller 52 based on temperature measurements, machine load determinations, etc., and include the desired operating speed of hydraulic cooling fan 66. Generally, engine controller 52 adjusts the speed of hydraulic cooling fan 66 by commanding hydraulic pump 72 to a certain displacement, which provides a certain pressure within hydraulic circuit 70. As discussed above, hydraulic pump 72 is solenoid controlled, so engine controller 52 determines and sets a current to the solenoid to change the displacement of hydraulic pump 72. Since hydraulic cooling fan 66 is powered by a constant displacement hydraulic motor, the operating speed of hydraulic cooling fan 66 is proportional to the pressure within hydraulic circuit 70. Advantageously, the operating speed of hydraulic cooling fan 66 is constant when the pressure within hydraulic circuit 70 is constant. Pressure sensor 74 measures the hydraulic pressure within hydraulic circuit 70, and provides these data to engine controller 52. Both open and closed loop control system architectures may be used. For example, a closed loop control system architecture may incorporate pressure sensor 74 data, while an open loop control system architecture, once calibrated, may not incorporate pressure sensor 74 data.

In known systems, the parasitic power consumed by hydraulic cooling fan 66 reduces the available engine power, which creates a commensurate reduction in machine performance, such as, for example, motorgrader drawbar performance. Adjusting the engine power upwards at a given engine speed, by increasing the amount of fuel provided to the engine 54, compensates for this parasitic loss and recovers machine performance. In one example, the engine 54 may be operating at a given engine speed under a derated power curve, and additional power may be generated by increasing the fuel provided to engine 54 from the amount specified by the derated power curve up to the maximum fuel amount specified by the full power curve for that engine speed. The amount of the increase in fuel is based on a hydraulic cooling fan performance curve, which may be stored in the non-volatile memory of engine controller 52.

Figure 3:
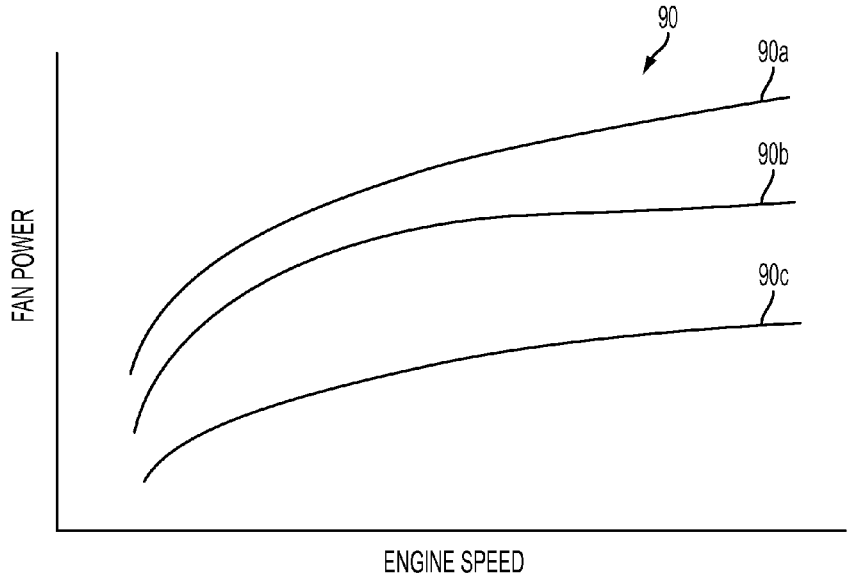
FIG. 3 presents hydraulic cooling fan compensation curves, in accordance with the present disclosure.

FIG. 3 presents a hydraulic cooling fan power compensation curves 90 at sea level, in accordance with the present disclosure. Fan power compensation curves 90*a*, 90*b*, 90*c* present the amount of power consumed by the hydraulic cooling fan 66 as a function of engine speed for three different fan commands. Engine controller 52 determines the power consumed by the hydraulic cooling fan 66 at a given engine speed, converts the power to a torque value, estimates the additional fuel amount required to compensate for this torque value, and adds this additional fuel amount to the baseline fuel amount, determined by the particular engine power curve currently employed, to yield the compensated fuel amount. Operating engine 54 at a derated percentage of maximum engine power advantageously provides headroom to compensate for parasitic hydraulic cooling fan power losses. If the compensated fuel amount exceeds the maximum fuel amount provided by the full power curve, then the compensated fuel amount may be reduced to the maximum fuel amount to avoid exceeding full engine power.

Figure 4:
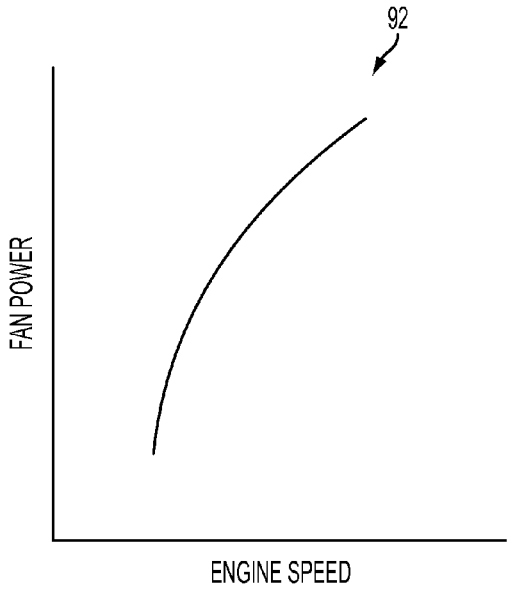
FIG. 4 presents a hydraulic cooling fan engine speed compensation curve, in accordance with the present disclosure.
Figure 5:
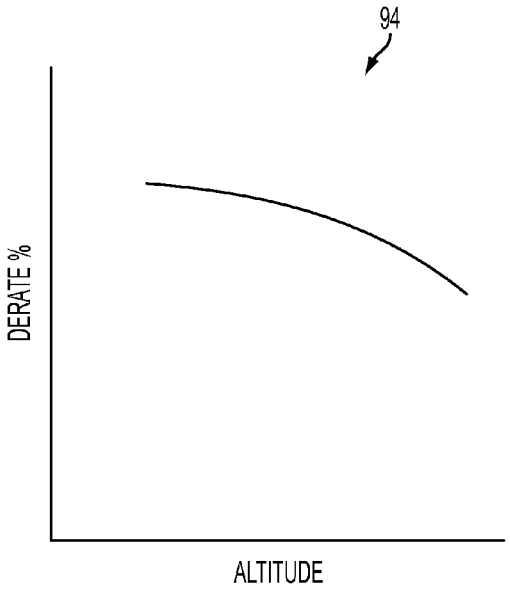
FIG. 5 presents a hydraulic cooling fan altitude compensation curve, in accordance with the present disclosure.

Additionally, the effects of altitude on parasitic hydraulic cooling fan power losses may also be considered, either separately or in combination with the above methodology. FIG. 4 presents a nominal hydraulic cooling fan power compensation curve 92, in accordance with the present disclosure, while FIG. 5 presents a hydraulic cooling fan altitude compensation curve 94, in accordance with the present disclosure.

Fan power compensation curve 92 provides the amount of power consumed by the hydraulic cooling fan 66 as a function of engine speed for a nominal fan command, while fan altitude compensation curve 94 provides derate factors as a function of altitude. Pressure sensor 53 measures atmospheric pressure, and provides these data to engine controller 52. When used separately from above methodology, engine controller 52 determines the power consumed by the hydraulic cooling fan 66 at the given engine speed and the altitude derate factor at the given altitude, multiplies these values together, converts the power to a torque value, estimates the additional fuel amount required to compensate for this torque value, and adds this additional fuel amount to the baseline fuel amount, determined by the engine power curve, to yield an altitude compensated fuel amount. If the compensated fuel amount exceeds the maximum fuel amount provided by the full power curve, then the compensated fuel amount may be reduced to the maximum fuel amount to avoid exceeding full engine power.

When used in conjunction with the above methodology, engine controller 52 determines the steady state power consumed by the hydraulic cooling fan 66 at the given engine speed and the altitude derate factor at the given altitude, multiplies these values together to produce an altitude compensated power, compares the sea level compensated power to the altitude compensated power, selects the minimum power, converts the minimum power to a torque value, estimates the additional fuel amount required to compensate for this torque value, and adds this additional fuel amount to the baseline fuel amount, determined by the engine power curve, to yield the compensated fuel amount. If the compensated fuel amount exceeds the maximum fuel amount provided by the full power curve, then the compensated fuel amount may be reduced to the maximum fuel amount to avoid exceeding full engine power. This method accounts for fan power when limited by the altitude air density or the fan controller system.

Figure 6:
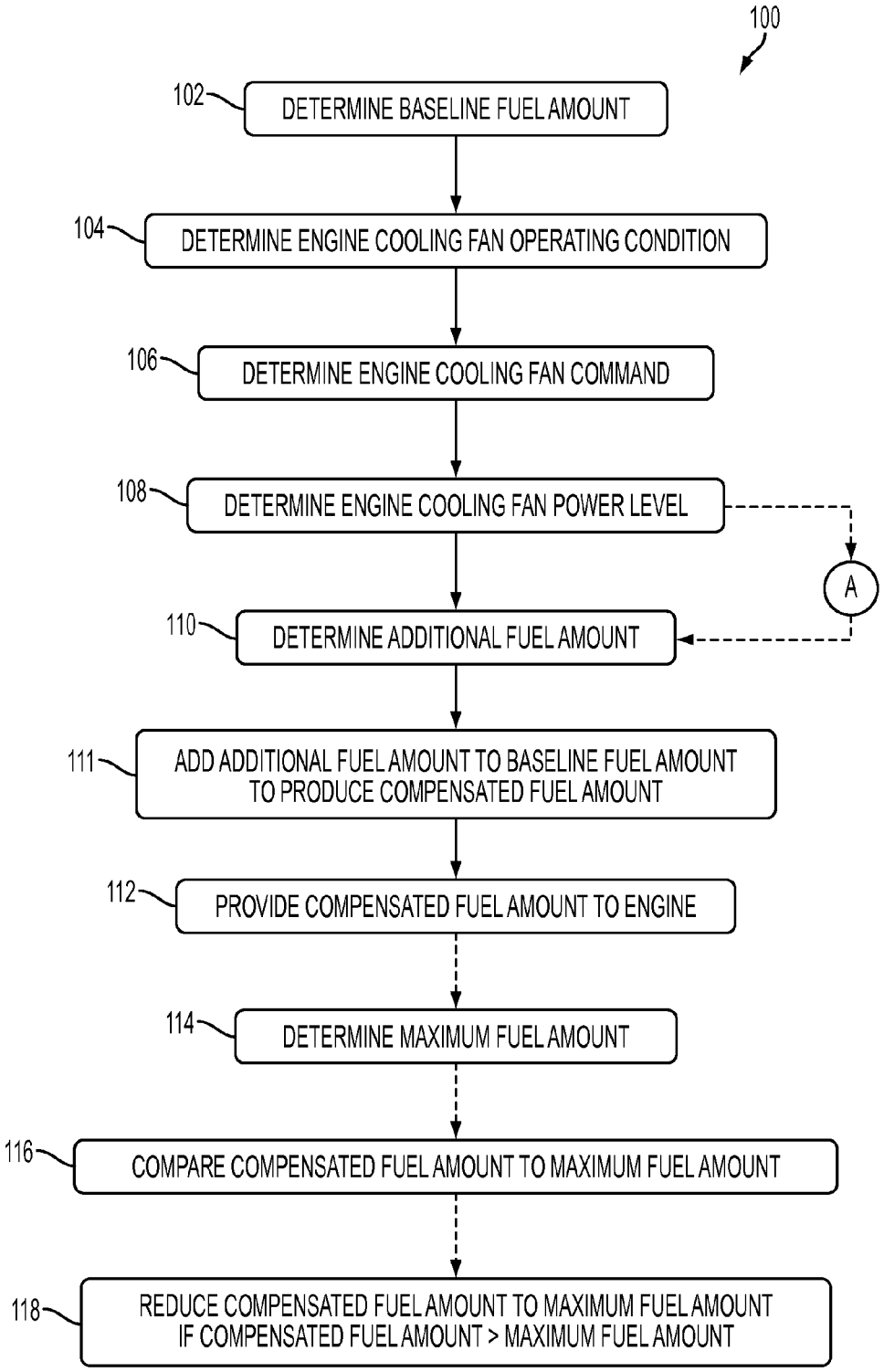
FIG. 6 presents a flow chart depicting a method for controlling the power of an engine, in accordance with the present disclosure.

FIG. 6 presents a flow chart depicting a method 100 for controlling the power of an engine, in accordance with the present disclosure.

Engine controller 52 determines a baseline fuel amount 102 for engine 54. Engine controller 52 may determine the baseline fuel amount by inspecting a derated engine power curve that includes fuel amount as a function of engine speed.

Engine controller 52 determines an engine cooling fan operating condition 104 based on at least one engine operating parameter. The engine operating parameter may be an engine speed, an engine block temperature, a transmission temperature, an air temperature, a coolant temperature, a hydraulic oil temperature, or various combinations of these parameters. The engine cooling fan operating condition may be the speed of the hydraulic cooling fan 66, or, alternatively, the engine cooling fan operating condition may be the pressure within hydraulic circuit 70, as measured by pressure sensor 74. The operating condition may be expressed as percentage, such as, for example, 70%.

Engine controller 52 determines an engine cooling fan command 106 based on the engine cooling fan operating condition. The hydraulic cooling fan 66 may be connected to a constant displacement hydraulic motor 68 that is coupled to a solenoid-controlled variable displacement hydraulic pump 72. As discussed above, because hydraulic cooling fan 66 is powered by a constant displacement hydraulic motor 68, the operating speed of hydraulic cooling fan 66 is proportional to the pressure within hydraulic circuit 70. Engine controller 52 adjusts the speed of hydraulic cooling fan 66 by commanding hydraulic pump 72 to a certain displacement, which provides a certain pressure within hydraulic circuit 70 that is associated with the desired operating speed of the hydraulic cooling fan 66. The relationship between hydraulic cooling fan operating speed and hydraulic circuit pressure may be set forth in a curve or table stored in non-volatile memory in engine controller 52. Engine controller 52 may also close a control loop around the pressure in the hydraulic circuit 70 using the measured pressure provided by pressure sensor 74. In one embodiment, the engine cooling fan command 106 is a solenoid current that is based on the calculated pressure.

Engine controller 52 determines an engine cooling fan power level 108 based on the engine speed and the engine cooling fan command. For example, engine controller 52 may inspect fan power compensation curve 90*b*, which may be a nominal fan command, for consumed power level based on the engine speed. Alternatively, the engine cooling fan power level 108 may be determined from the pressure measured by pressure sensor 74 and the fan speed or hydraulic pump displacement.

Engine controller 52 determines an additional fuel amount 110 based on the engine cooling fan power level. Engine controller 52 may convert the consumed power level to an engine torque value by dividing the power level by the operating speed of the engine 54. Engine controller 52 then determines or estimates the additional fuel amount based on the torque value by consulting a curve or table stored in non-volatile memory in engine controller 52, or, alternatively, by direct calculation.

Engine controller 52 adds the additional fuel amount 111 to the baseline fuel amount to produce a compensated fuel amount.

Engine controller 52 then provides the compensated fuel amount 112 to the engine 54. More particularly, engine controller 52 provides control signals to engine 54 and/or fuel system 80 to provide the compensated fuel amount to engine 54.

Additionally, engine controller 52 may determine a maximum fuel amount 114 based on the speed of the engine 54, compare the compensated fuel amount to the maximum fuel amount 116, and if the compensated fuel amount is greater than the maximum fuel amount, reduce the compensated fuel amount to the maximum fuel amount 118. Engine controller 52 may determine the maximum fuel amount by inspecting the full power curve.

Figure 7:
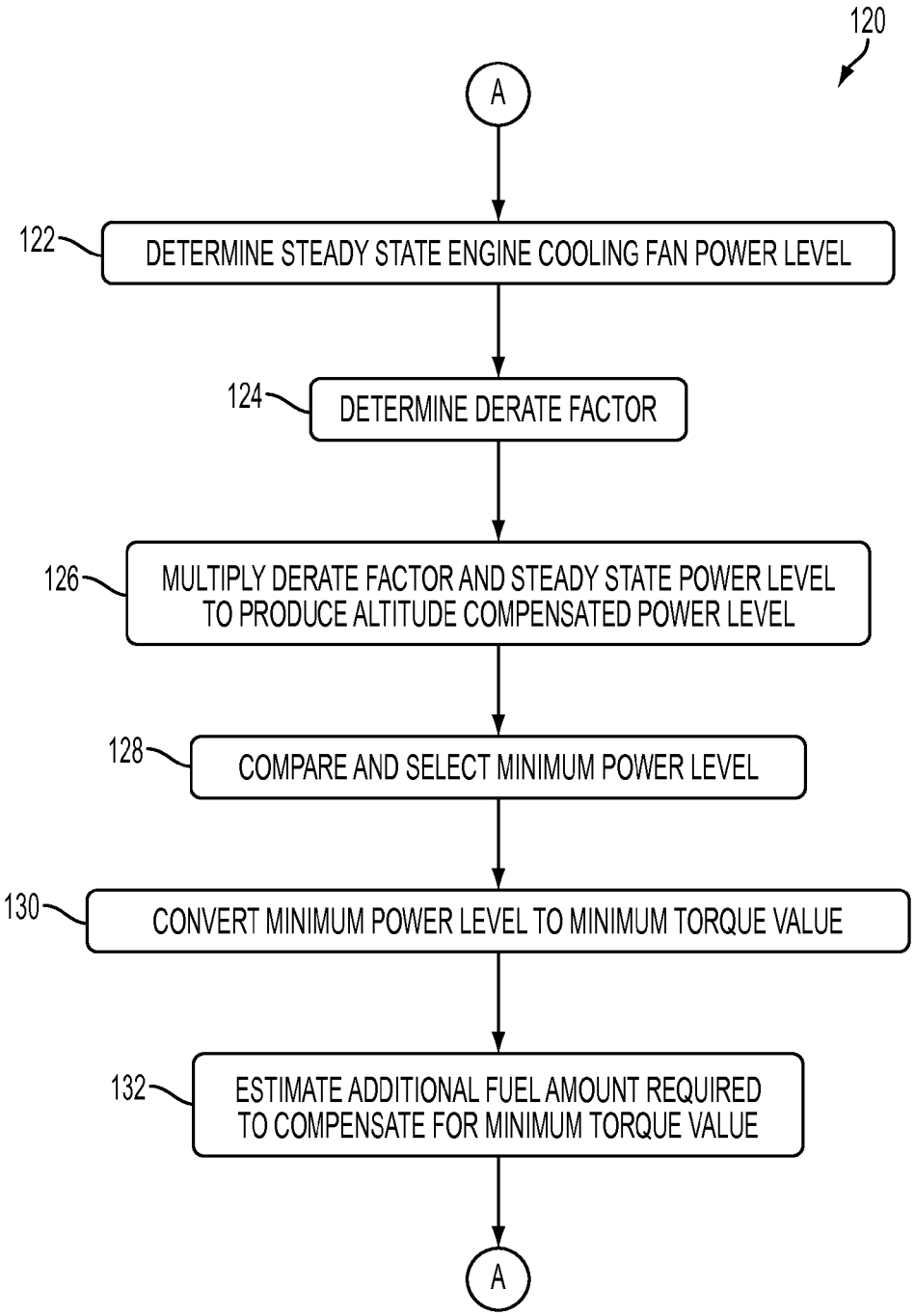
FIG. 7 presents a flow chart depicting another method for controlling the power of an engine, in accordance with the present disclosure.

FIG. 7 presents a flow chart depicting another method 120 for controlling the power of an engine, in accordance with the present disclosure. Method 120 is an extension of method 100, and the symbol "A" in a circle links methods 100 and 120 depicted in FIGS. 6 and 7, respectively. In this feature, the engine cooling fan power level calculated in method 100 is a sea level compensated power level.

Engine controller 52 determines a steady state engine cooling fan power level 122 based on the engine speed. Engine controller 52 may inspect fan power compensation curve 92 for the steady state engine cooling fan power level.

Engine controller 52 determines a derate factor 124 based on an altitude of the engine. Engine controller 52 may inspect fan altitude compensation curve 94 for the derate factor. Engine controller 52 multiplies the derate factor and the steady state power level to produce an altitude compensated power level 126. Engine controller 52 compares the sea level compensated power level to the altitude compensated power level and selects the minimum power level 128. Engine controller 52 then converts the minimum power level to a minimum torque value 130, as described above. Engine controller 52 estimates the additional fuel amount required to compensate for the minimum torque value 132.

Generally, the present disclosure advantageously provides methods for controlling the power of an engine. For example, one method for controlling the power of an engine includes determining a baseline fuel amount for the engine, determining an increased fuel amount greater than the baseline fuel amount to compensate for cooling fan power, and providing the increased fuel amount to the engine. Another method for controlling the power of an engine includes determining a maximum fuel amount for the engine, determining a reduced fuel amount less than the maximum fuel amount to compensate for the difference between a maximum cooling fan power and an actual cooling fan power, and providing the reduced fuel amount to the engine.

The many features and advantages of the present disclosure are apparent from the detailed specification, and, thus, it is intended by the appended claims to cover all such features and advantages of the present disclosure which fall within the true spirit and scope of the present disclosure. Further, since numerous modifications and variations will readily occur to those skilled in the art, it is not desired to limit the disclosure to the exact construction and operation illustrated and described, and, accordingly, all suitable modifications and equivalents may be resorted to that fall within the scope of the present disclosure.

What is claimed is:

1. A method for preventing the power consumed by an internal combustion machine engine cooling fan from derating the available machine engine power comprising:

determining a baseline fuel amount for the engine;

determining an engine cooling fan operating condition based on at least one engine operating parameter;

determining an engine cooling fan command based on an engine cooling fan operating condition;

determining an engine cooling fan power level based on the engine speed and the engine cooling fan command;

determining an additional fuel amount needed over the baseline fuel amount, if any, based on the engine cooling fan power level;

adding the additional fuel amount to the baseline fuel amount to create a compensated fuel amount; and providing the compensated fuel amount to the engine thereby preventing any increased engine cooling fan power requirements from derating the available machine engine power.

2. The method of claim 1, wherein determining the baseline fuel amount includes inspecting a derated engine power curve that provides fuel amount as a function of engine speed.

3. The method of claim 1, wherein the engine operating parameter is at least one of an engine speed, an engine block temperature, a transmission temperature, an air temperature, a coolant temperature, or a hydraulic oil temperature.

4. The method of claim 1, wherein the engine cooling fan operating condition is speed.

5. The method of claim 4, wherein the engine cooling fan is connected to a constant displacement hydraulic motor that is coupled to a solenoid controlled variable displacement hydraulic pump, and the engine cooling fan command is an electrical current command to the hydraulic pump solenoid.

6. The method of claim 5, wherein determining an engine cooling fan power level includes inspecting a fan compensation curve that provides consumed fan power level as a function of engine speed and solenoid electrical current command.

7. The method of claim 6, wherein determining an additional fuel amount includes converting the consumed fan power level to a torque value and estimating the additional fuel amount based on the torque value.

8. The method of claim 1, further comprising:

determining a maximum fuel amount based on a speed of the engine;

comparing the compensated fuel amount to the maximum fuel amount; and if the compensated fuel amount is greater than the maximum fuel amount, reducing the compensated fuel amount to the maximum fuel amount.

9. The method of claim 8, wherein determining the maximum fuel amount includes inspecting a full engine power curve that provides fuel amount as a function of engine speed.

10. The method of claim 1, wherein the engine cooling fan power level is a sea level compensated power level, and the method further comprises:

determining a steady state engine cooling fan power level based on the engine speed;

determining a derate factor based on an altitude of the engine;

multiplying the derate factor and the steady state power level to produce an altitude compensated power level;

comparing the sea level compensated power level to the altitude compensated power level and selecting a minimum power level;

converting the minimum power level to a minimum torque value; and calculating the additional fuel amount required to compensate for the minimum torque value.

11. The method of claim 10, wherein determining the steady state engine cooling fan power level includes inspecting a fan compensation curve that provides consumed fan power level as a function of engine speed.

12. An engine system, comprising:

an engine;

a fuel system coupled to the engine;

a cooling system, coupled to the engine, including a radiator, a hydraulic cooling fan connected to a hydraulic motor, and a hydraulic pump coupled to the hydraulic motor; and an engine controller, coupled to the engine, the fuel system and the hydraulic pump, including a processor adapted to perform a set of instructions that controls the power of the engine to prevent the power consumed by the cooling fan from derating the available machine engine power, the instructions including:

determining a baseline fuel amount for the engine, determining an engine cooling fan operating condition based on at least one engine operating parameter, determining an engine cooling fan command based on the engine cooling fan operating condition, determining an engine cooling fan power level based on the engine speed and the engine cooling fan command, determining an additional fuel amount needed over the baseline fuel amount, if any, based on the engine cooling fan power level, adding the additional fuel amount to the baseline fuel amount to create a compensated fuel amount, and providing the compensated fuel amount to the engine thereby preventing any increased engine cooling fan power requirements from derating the available machine engine power.

13. The engine system of claim 12, wherein determining the baseline fuel amount includes inspecting a derated engine power curve that provides fuel amount as a function of engine speed.

14. The engine system of claim 12, wherein the engine operating parameter is at least one of an engine speed, an engine block temperature, a transmission temperature, an air temperature, a coolant temperature, or a hydraulic oil temperature, and wherein the engine cooling fan operating condition is speed.

15. The engine system of claim 14, wherein the engine cooling fan command is an electrical current command to the hydraulic pump solenoid, and wherein determining an engine cooling fan power level includes inspecting a fan compensation curve that provides consumed power level as a function of engine speed and solenoid electrical current command.

16. The engine system of claim 15, wherein determining an additional fuel amount includes converting the consumed power level to a torque value and estimating the additional fuel amount based on the torque value.

17. The engine system of claim 12, where the instructions further comprise:

determining a maximum fuel amount based on a speed of the engine;

comparing the compensated fuel amount to the maximum fuel amount; and if the compensated fuel amount is greater than the maximum fuel amount, reducing the compensated fuel amount to the maximum fuel amount.

18. The engine system of claim 12, wherein determining the maximum fuel amount includes inspecting a full engine power curve that provides fuel amount as a function of engine speed.

19. The engine system of claim 12, wherein the engine cooling fan power level is a sea level compensated power level, and the instructions further comprise:

determining a steady state engine cooling fan power level based on the engine speed by inspecting a fan compensation curve;

determining a derate factor based on an altitude of the engine;

multiplying the derate factor and the steady state power level to produce an altitude compensated power level;

comparing the sea level compensated power level to the altitude compensated power level and selecting a minimum power level;

converting the minimum power level to a minimum torque value; and estimating the additional fuel amount required to compensate for the minimum torque value.

20. A method for preventing the power consumed by an internal combustion machine engine cooling fan from derating the available machine engine power comprising:

determining a baseline fuel amount for the engine;

determining an increased fuel amount greater than the baseline fuel amount, if any, needed to compensate for cooling fan power; and providing the increased fuel amount to the engine thereby preventing any increased engine cooling fan power requirements from derating the available machine engine power.

* * * * *